US011854495B2

(12) United States Patent
Park et al.

(10) Patent No.: US 11,854,495 B2
(45) Date of Patent: Dec. 26, 2023

(54) DISPLAY DEVICE AND DISPLAY DRIVING METHOD

(71) Applicant: LG Display Co., Ltd., Seoul (KR)

(72) Inventors: Sangjae Park, Paju-si (KR); Minsung Kang, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/963,979

(22) Filed: Oct. 11, 2022

(65) Prior Publication Data

US 2023/0122681 A1 Apr. 20, 2023

(51) Int. Cl.

| | |
|---|---|
| ***G09G 3/3291*** | (2016.01) |
| ***G09G 3/3233*** | (2016.01) |
| ***G09G 3/20*** | (2006.01) |

(52) U.S. Cl.

CPC ..... *G09G 3/3291* (2013.01); *G09G 3/2007* (2013.01); *G09G 3/2096* (2013.01); *G09G 3/3233* (2013.01); *G09G 2300/0828* (2013.01); *G09G 2300/0842* (2013.01); *G09G 2320/0233* (2013.01); *G09G 2330/021* (2013.01); *G09G 2360/16* (2013.01)

(58) Field of Classification Search

CPC .. G09G 3/3291; G09G 3/2007; G09G 3/2096; G09G 3/3233; G09G 2300/0828; G09G 2300/0842; G09G 2320/0233; G09G 2330/021; G09G 2360/16

See application file for complete search history.

(56) References Cited

U.S. PATENT DOCUMENTS

| | | | | |
|---|---|---|---|---|
| 7,295,174 | B2 * | 11/2007 | Watanabe | G09G 3/22 345/537 |
| 11,056,067 | B2 * | 7/2021 | Jun | G09G 3/3688 |
| 2007/0229420 | A1 * | 10/2007 | Hwang | G09G 3/006 345/87 |
| 2011/0148941 | A1 * | 6/2011 | Kim | G09G 3/3426 345/102 |
| 2014/0062881 | A1 * | 3/2014 | Solomon | G06F 3/0346 345/158 |
| 2014/0300937 | A1 * | 10/2014 | Choe | G09G 3/3225 358/480 |

(Continued)

*Primary Examiner* — Amare Mengistu
*Assistant Examiner* — Jennifer L Zubajlo
(74) *Attorney, Agent, or Firm* — SEED IP LAW GROUP LLP

(57) ABSTRACT

Embodiments of the disclosure relate to a display device and a display driving method. Specifically, there may be provided a display device comprising a display panel including a plurality of subpixels and a plurality of driving voltage lines supplying a driving voltage to the plurality of subpixels, a plurality of data driving circuits supplying a data voltage to the display panel, a timing controller controlling the plurality of data driving circuits to supply a compensated data voltage according to a position of the display panel, wherein in the compensated data voltage, a first compensation gain for at least some subpixels is varied depending on positions corresponding to the plurality of data driving circuits in a first direction of the display panel, and a second compensation gain for at least some subpixels is varied depending on distances from the plurality of data driving circuits in a second direction of the display panel.

17 Claims, 13 Drawing Sheets

(56) References Cited

U.S. PATENT DOCUMENTS

| | | | | |
|---|---|---|---|---|
| 2015/0269904 | A1* | 9/2015 | Tsai | G09G 5/02 345/520 |
| 2016/0196778 | A1* | 7/2016 | Cha | G09G 3/03 345/694 |
| 2017/0345377 | A1* | 11/2017 | Oh | G09G 3/3291 |
| 2019/0035339 | A1* | 1/2019 | Sako | G09G 3/3648 |
| 2019/0164485 | A1* | 5/2019 | Tomitani | G09G 3/3233 |
| 2020/0264346 | A1* | 8/2020 | Wang | G02B 19/0066 |
| 2021/0005128 | A1* | 1/2021 | Li | G09G 3/3225 |
| 2021/0150974 | A1* | 5/2021 | Sohn | G09G 3/32 |
| 2021/0201849 | A1* | 7/2021 | Choi | G09G 3/20 |
| 2021/0327346 | A1* | 10/2021 | Wu | H10K 59/1213 |
| 2022/0051606 | A1* | 2/2022 | Kim | G09G 3/2007 |
| 2023/0081260 | A1* | 3/2023 | Lee | G09G 3/3291 345/94 |
| 2023/0082641 | A1* | 3/2023 | Yu | G06T 3/0081 |

* cited by examiner

FIG. 8

| | 0G | 16G | 32G | ··· | 255G |
|---|---|---|---|---|---|
| GL1 | 240/256 | 236/256 | 230/256 | ··· | 208/256 |
| GL2 | 242/256 | 240/256 | 232/256 | ··· | 212/256 |
| GL3 | 244/256 | 242/256 | 236/256 | ··· | 216/256 |
| ⋮ | ⋮ | ⋮ | ⋮ | ··· | ⋮ |
| GLn | 256/256 | 256/256 | 256/256 | ··· | 256/256 |

DISPLAY DEVICE AND DISPLAY DRIVING METHOD

CROSS-REFERENCE TO RELATED APPLICATION

This application claims priority from Korean Patent Application No. 10-2021-0138625, filed on Oct. 18, 2021, which is hereby incorporated by reference for all purposes as if fully set forth herein.

BACKGROUND

Technical Field

Embodiments of the disclosure relate to a display device, a data driving circuit, and a display driving method, which may enhance the luminance uniformity of a display panel by compensating for a data voltage considering a voltage drop of the driving voltage which varies depending on the position of the subpixel.

Description of Related Art

As the information society develops, various demands for display devices for displaying images are increasing, and various types of display devices, such as liquid crystal displays (LCDs) and organic light emitting displays, are used.

Among these display devices, the organic light emitting diode display adopts organic light emitting diodes and thus has fast responsiveness and various merits in contrast ratio, luminous efficiency, brightness, and viewing angle.

The organic light emitting diode display include organic light emitting diodes in subpixels arranged on the display panel and emits the organic light emitting diodes by controlling the current flowing to the organic light emitting diodes, thereby controlling the brightness represented by each subpixel while displaying an image.

Such a display device includes a driving voltage supply source for supplying various driving voltages necessary for driving the display panel to the driving circuit and the display panel and various components for transferring the driving voltage.

BRIEF SUMMARY

The inventors have realized that the voltage drop of the driving voltage transferred through the driving voltage line in the display panel differs depending on the position of the subpixel, and as such, the luminance may vary depending on the position in the display panel.

Thus, a variation in light emitting luminance, so-called luminance non-uniformity, may occur in a specific position of the display panel, degrading the image quality.

Accordingly, research for methods for enhancing the luminance uniformity of the display panel is underway. However, since each subpixel in the display panel emits light in a different luminance depending on the horizontal or vertical two-dimensional (2D) position, a method which is capable of controlling light emitting luminance considering the two-dimensional position of the subpixel so as to increase the luminance uniformity of the display panel is beneficial.

The inventors of the specification have invented a display device and display driving method which may enhance luminance uniformity by compensating for the data voltage considering the voltage drop of the driving voltage which varies depending on the two-dimensional position of the subpixel in the display panel.

Embodiments of the disclosure may provide a display device and display driving method which may mitigate luminance non-uniformity according to the two-dimensional position of the subpixel considering different criteria for the voltage drop of the driving voltage to a first direction of the display panel and a second direction perpendicular to the first direction.

Embodiments of the disclosure may provide a display device and display driving method which may mitigate luminance non-uniformity according to the two-dimensional position of the subpixel considering the voltage drop of the driving voltage, which varies depending on the position corresponding to the data driving circuit, in the first direction of the display panel and the voltage drop of the driving voltage, which varies depending on the resistance component of the driving voltage line, in the second direction of the display panel.

Embodiments of the disclosure may provide a display device and a display driving method which may effectively mitigate luminance non-uniformity according to the two-dimensional position of the subpixel considering the voltage drop of the driving voltage, which varies depending on the pattern of input image data.

According to embodiments of the disclosure, there may be provided a display device comprising a display panel including a plurality of subpixels and a plurality of driving voltage lines supplying a driving voltage to the plurality of subpixels, a plurality of data driving circuits configured to supply a data voltage to the display panel, a timing controller configured to control the plurality of data driving circuits for supplying a compensated data voltage according to a position of the display panel, wherein the compensated data voltage has a first compensation gain for at least some subpixels which is varied depending on positions corresponding to the plurality of data driving circuits in a first direction of the display panel, and a second compensation gain for at least some subpixels which is varied depending on distances from the plurality of data driving circuits in a second direction of the display panel.

According to embodiments of the disclosure, there may be provided a display device and display driving method which may enhance luminance uniformity by compensating for the data voltage considering the voltage drop of the driving voltage which varies depending on the two-dimensional position of the subpixel in the display panel.

According to embodiments of the disclosure, there may be provided a display device and display driving method which may mitigate luminance non-uniformity according to the two-dimensional position of the subpixel considering different criteria for the voltage drop of the driving voltage in a first direction of the display panel and a second direction perpendicular to the first direction.

According to embodiments of the disclosure, there may be provided a display device and display driving method which may mitigate luminance non-uniformity according to the two-dimensional position of the subpixel considering the voltage drop of the driving voltage, which varies depending on the position corresponding to the data driving circuit, in the first direction of the display panel and the voltage drop of the driving voltage, which varies depending on the resistance component of the driving voltage line, in the second direction of the display panel.

According to embodiments of the disclosure, there may be provided a display device and a display driving method which may effectively mitigate luminance non-uniformity according to the two-dimensional position of the subpixel considering the voltage drop of the driving voltage, which varies depending on the pattern of input image data.

DESCRIPTION OF SEVERAL VIEWS OF THE DRAWINGS

The above and other benefits, features, and advantages of the present disclosure will be more clearly understood from the following detailed description, taken in conjunction with the accompanying drawings, in which:

FIG. 8 is a view illustrating an example of setting a different second compensation gain of a data voltage depending on a pattern of an input image in a display device according to embodiments of the disclosure;

DETAILED DESCRIPTION

Figure 1:
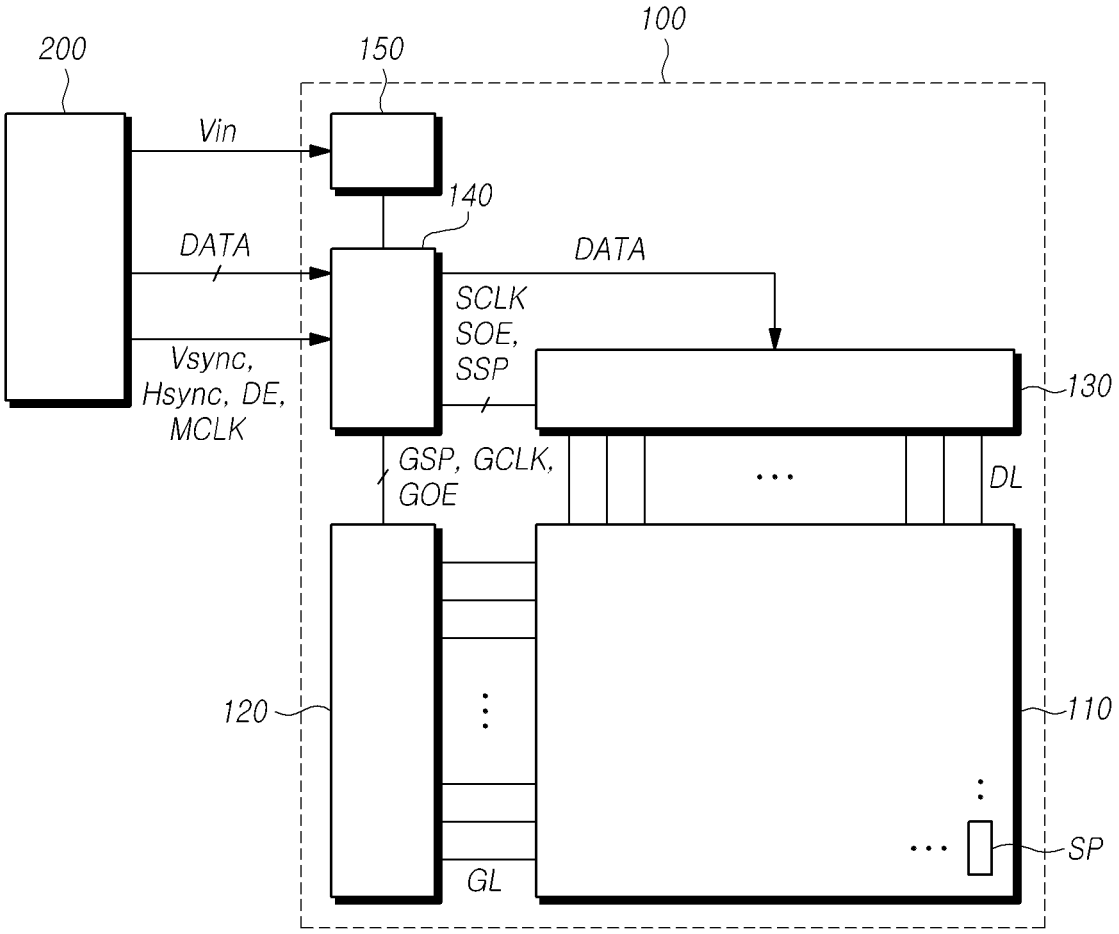
FIG. 1 is a view schematically illustrating a configuration of a display device according to various embodiments of the disclosure.

Hereinafter, some embodiments of the present disclosure will be described in detail with reference to the drawings. In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements, etc., but is used merely to distinguish the corresponding element from other elements.

When it is mentioned that a first element "is connected or coupled to", "contacts or overlaps", etc., a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc., each other via a fourth element. Here, the second element may be included in at least one of two or more elements that "are connected or coupled to", "contact or overlap", etc., each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes, etc., are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

Hereinafter, various embodiments of the present disclosure will be described in detail with reference to the accompanying drawings.

FIG. 1 is a view schematically illustrating a configuration of a display device according to various embodiments of the disclosure.

Referring to FIG. 1, a display device 100 according to embodiments of the disclosure may include a display panel 110 where a plurality of gate lines GL and data lines DL are connected, and a plurality of subpixels SP are arranged in a matrix form, a gate driving circuit 120 driving the plurality of gate lines GL, a data driving circuit 130 supplying a data voltage through the plurality of data lines DL, a timing controller 140 controlling the gate driving circuit 120 and the data driving circuit 130, and a power management circuit 150.

The display panel 110 displays an image based on a scan signal transferred from the gate driving circuit 120 through the plurality of gate line GLs GL and the data voltage transferred from the data driving circuit 130 through the plurality of data lines DL.

In the case of an organic light emitting display, the display panel 110 may be implemented in a top emission scheme, a bottom emission scheme, or a dual-emission scheme.

In the display panel 110, a plurality of pixels may be arranged in a matrix form, and each pixel may include subpixels SP having different colors, e.g., a white subpixel, a red subpixel, a green subpixel, and a blue subpixel, and each subpixel SP may be defined by (e.g., positioned at regions of overlap of) the plurality of data lines DL and the plurality of gate lines GL.

One subpixel SP may include, e.g., a thin film transistor (TFT) formed at the region of overlap between one data line DL and one gate line GL, a light emitting element, such as an organic light emitting diode, charged with the data voltage, and a storage capacitor electrically connected to the light emitting element to maintain the voltage.

For example, when the display device 100 having a resolution of 2,160×3,840 includes four subpixels SP of white (W), red (R), green (G), and blue (B), 3,840 data lines DL may be connected to 2,160 gate lines GL and four subpixels WRGB, and thus, there may be provided 3,840×4=15,360 data lines DL. Each subpixel SP is disposed at the region of overlap between the gate line GL and the data line DL.

The gate driving circuit 120 may be controlled by the controller 140 to sequentially output scan signals to the plurality of gate lines GL disposed in the display panel 110, controlling the driving timing of the plurality of subpixels SP.

In the display device 100 having a resolution of 2,160×3,840, sequentially outputting the scan signal to the 2,160 gate lines GL from the first gate line to the 2,160th gate line may be referred to as 2,160-phase driving. Sequentially outputting the scan signal to each group of four gate lines GL, e.g., sequentially outputting the scan signal to the fifth gate line to the eighth gate line after sequentially outputting the scan signal to the first gate line to the fourth gate line, is referred to as 4-phase driving. In other words, sequentially outputting the scan signal to every N gate lines GL may be referred to as N-phase driving.

The gate driving circuit 120 may include one or more gate driving integrated circuits (GDICs). Depending on driving schemes, the gate driving circuit 120 may be positioned on only one side, or each of two opposite sides, of the display panel 110. The gate driving circuit 120 may be implemented in a gate-in-panel (GIP) form which is embedded in the bezel area of the display panel 110.

The data driving circuit 130 receives image data DATA from the timing controller 140 and converts the received image data DATA into an analog data voltage. Then, as the data voltage is output to each data line DL according to the timing when the scan signal is applied through the gate line GL, each subpixel SP connected to the data line DL displays a light emitting signal having the brightness corresponding to the data voltage.

Likewise, the data driving circuit 130 may include one or more source driving integrated circuits SDIC, and the source driving integrated circuit SDIC may be connected to the bonding pad of the display panel 110 in a tape automated bonding (TAB) type or a chip-on-glass (COG) type or may be disposed directly on the display panel 110.

In some cases, each source driving integrated circuit SDIC may be integrated and disposed on the display panel 110. Further, each source driving integrated circuit SDIC may be implemented in a chip-on-film (COF) type and, in this case, each source driving integrated circuit SDIC may be mounted on a circuit film and may be electrically connected to the data line DL of the display panel 110 through the circuit film.

The timing controller 140 supplies various control signals to the gate driving circuit 120 and the data driving circuit 130 and controls the operation of the gate driving circuit 120 and the data driving circuit 130. In other words, the timing controller 140 may control the gate driving circuit 120 to output a scan signal according to the timing implemented in each frame and, on the other hand, transfers the image data DATA received from the outside to the data driving circuit 130.

In this case, the timing controller 140 receives, from an external host system 200, several timing signals including, e.g., a vertical synchronization signal Vsync, a horizontal synchronization signal Hsync, a data enable signal DE, and a main clock MCLK, together with the image data DATA.

The host system 200 may be any one of a television (TV) system, a set-top box, a navigation system, a personal computer (PC), a home theater system, a mobile device, and a wearable device. Accordingly, the timing controller 140 may generate a control signal according to various timing signals received from the host system 200 and transfers the control signal to the gate driving circuit 120 and the data driving circuit 130.

For example, the timing controller 140 outputs several gate control signals including, e.g., a gate start pulse GSP, a gate clock GCLK, and a gate output enable signal GOE, to control the gate driving circuit 120. The gate start pulse GSP controls the timing at which one or more gate driving integrated circuits GDIC constituting the gate driving circuit 120 start operation. The gate clock GCLK is a clock signal commonly input to one or more gate driving integrated circuits GDIC and controls the shift timing of the scan signal. The gate output enable signal GOE designates timing information about one or more gate driving integrated circuits GDICs.

The timing controller 140 outputs various data control signals including, e.g., a source start pulse SSP, a source sampling clock SCLK, and a source output enable signal SOE, to control the data driving circuit 130. The source start pulse SSP controls the timing at which one or more source driving integrated circuits SDIC constituting the data driving circuit 130 start data sampling. The source sampling clock SCLK is a clock signal that controls the timing of sampling data in the source driving integrated circuit SDIC. The source output enable signal SOE controls the output timing of the data driving circuit 130.

The display device 100 may further include a power management circuit 150 that supplies various voltages or currents to, e.g., the display panel 110, the gate driving circuit 120, and the data driving circuit 130 or controls various voltages or currents to be supplied.

The power management circuit 150 adjusts the direct current (DC) input voltage Vin supplied from the host system 200, generating power beneficial to drive the display panel 100, the gate driving circuit 120, and the data driving circuit 130.

The subpixel SP is positioned at the region of overlap between the gate line GL and the data line DL, and a light emitting element may be disposed in each subpixel SP. For example, the organic light emitting diode display may include a light emitting element, such as an organic light emitting diode, in each subpixel SP and may display an image by controlling the current flowing to the light emitting element according to the data voltage.

The display device 100 may be one of various types of devices, such as liquid crystal displays, organic light emitting diode displays, or plasma display panels.

Figure 2:
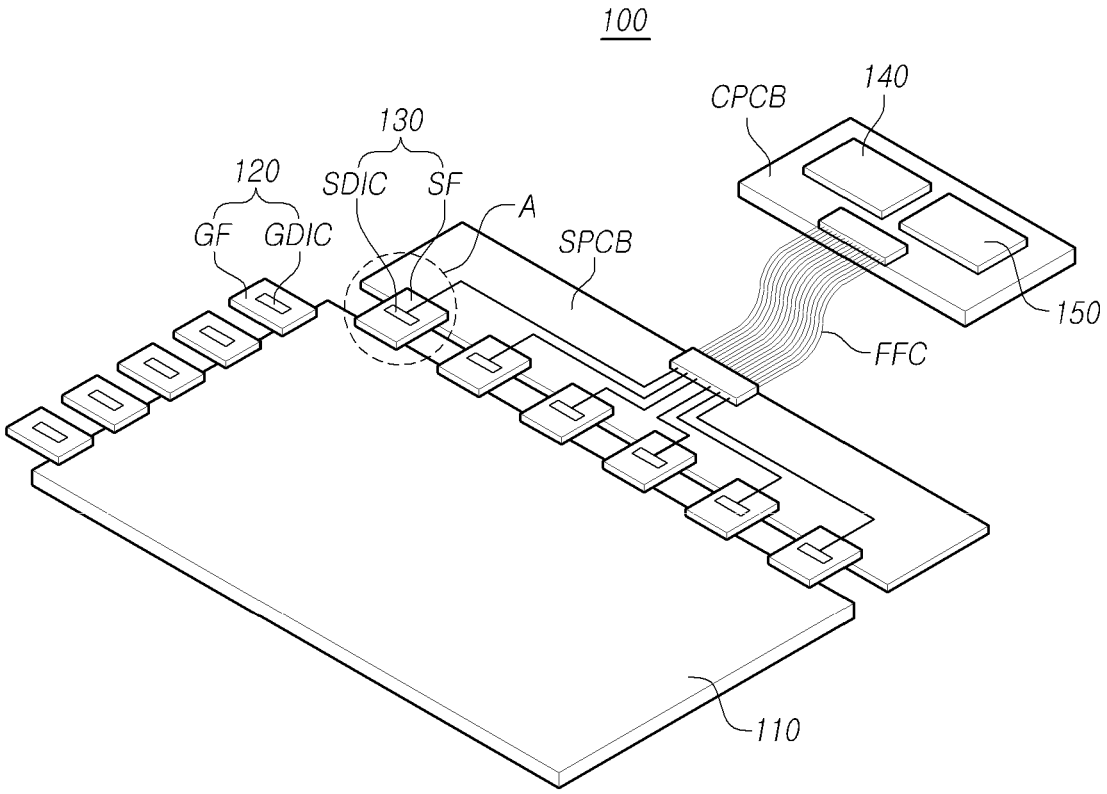
FIG. 2 is a view illustrating an example of a system of a display device according to embodiments of the disclosure.

FIG. 2 is a view illustrating an example of a system of a display device according to embodiments of the disclosure;

Referring to FIG. 2, in the display device 100 according to embodiments of the disclosure, the source driving integrated circuit SDIC included in the data driving circuit 130 and the gate driving integrated circuit GDIC included in the gate driving circuit 120 are implemented in the chip-on-film (COF) type among various types (e.g., TAB, COG, or COF).

One or more gate driving integrated circuits GDIC included in the gate driving circuit 120 each may be mounted on a gate film GF, and one side of the gate film GF may be electrically connected with the display panel 110. Lines for electrically connecting the gate driving integrated circuit GDIC and the display panel 110 may be disposed on the gate film GF.

The gate driving circuit 120 may be located only on one side of the display panel 110 or on each of two opposite sides according to driving methods. The gate driving circuit 120 may be implemented in a gate-in-panel (GIP) form which is embedded in the bezel area of the display panel 110.

Likewise, one or more source driving integrated circuits SDIC included in the data driving circuit 130 each may be mounted on the source film SF, and one side of the source film SF may be electrically connected with the display panel 110. Lines for electrically connecting the source driver integrated circuit SDIC and the display panel 110 may be disposed on the source film SF.

The display device 100 may include at least one source printed circuit board SPCB for circuit connection between a plurality of source driving integrated circuits SDIC and other devices and a control printed circuit board CPCB for mounting control components and various electric devices.

The other side of the source film SF where the source driving integrated circuit SDIC is mounted may be connected to at least one source printed circuit board SPCB. In other words, one side of the source film SF where the source driving integrated circuit SDIC is mounted may be electrically connected with the display panel 110, and the other side thereof may be electrically connected with the source printed circuit board SPCB.

The timing controller 140 and the power management circuit (power management IC) 150 may be mounted on the control printed circuit board CPCB. The timing controller 140 may control the operation of the data driving circuit 130 and the gate driving circuit 120. The power management circuit 150 may supply driving voltage or current to the display panel 110, the data driving circuit 130, and the gate driving circuit 120 and control the supplied voltage or current.

At least one source printed circuit board SPCB and control printed circuit board CPCB may be circuit-connected through at least one connection member. The connection member may include, e.g., a flexible printed circuit (FPC) or a flexible flat cable (FFC). In this case, the connection member connecting the at least one source printed circuit board SPCB and control printed circuit board CPCB may be varied depending on the size and type of the display device 100. The at least one source printed circuit board SPCB and control printed circuit board CPCB may be integrated into a single printed circuit board.

In the so-configured display device 100, the power management circuit 150 transfers a driving voltage beneficial for display driving or characteristic value sensing to the source printed circuit board SPCB through the flexible printed circuit FPC or flexible flat cable FFC. The driving voltage transferred to the source printed circuit board SPCB is supplied to emit light or sense a specific subpixel SP in the display panel 110 through the source driving integrated circuit SDIC.

Each of the subpixels SP arranged in the display panel 110 in the display device 100 may include an organic light emitting diode, which is a light emitting element, and a circuit element, e.g., a driving transistor, for driving the organic light emitting diode.

The type and number of circuit elements constituting each subpixel SP may be varied depending on functions to be provided and design schemes.

Figure 3:
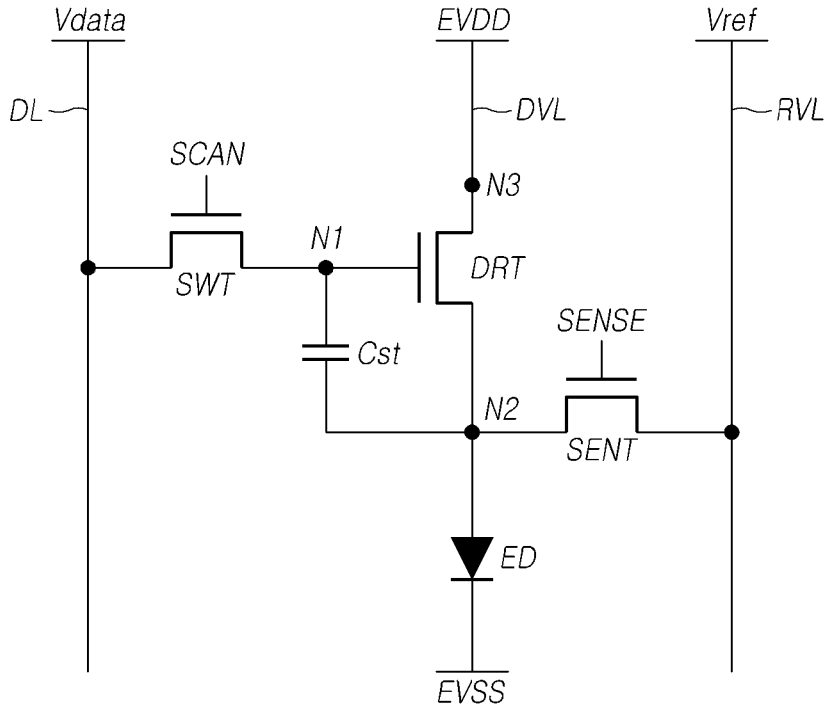
FIG. 3 is a view illustrating an example of a circuit constituting a subpixel in a display device according to embodiments of the disclosure.

FIG. 3 is a view illustrating an example of a circuit constituting a subpixel in a display device according to embodiments of the disclosure;

Referring to FIG. 3, in the display device 100 according to embodiments of the disclosure, the subpixel SP may include one or more transistors and a capacitor and an organic light emitting diode (OLED) as a light emitting element ED.

For example, the subpixel SP may include a driving transistor DRT, a switching transistor SWT, a sensing transistor SENT, a storage capacitor Cst, and a light emitting element ED.

The driving transistor DRT includes the first node N1, second node N2, and third node N3. The first node N1 of the driving transistor DRT may be a gate node to which the data voltage Vdata is applied from the data driving circuit 130 through the data line DL when the switching transistor SWT is turned on. The second node N2 of the driving transistor DRT may be electrically connected with the anode electrode of the light emitting element ED and may be the source node or drain node. The third node N3 of the driving transistor DRT may be electrically connected with the driving voltage line DVL to which the driving voltage EVDD is applied and may be the drain node or the source node.

In this case, during a display driving period, a driving voltage EVDD beneficial for displaying an image may be supplied to the driving voltage line DVL. For example, the driving voltage EVDD beneficial for displaying an image may be 27V.

The switching transistor SWT is electrically connected between the first node N1 of the driving transistor DRT and the data line DL, and the gate line GL is connected to the gate node. Thus, the switching transistor SWT is operated according to the scan signal SCAN supplied through the gate line GL. When turned on, the switching transistor SWT transfers the data voltage Vdata supplied through the data line DL to the gate node of the driving transistor DRT, thereby controlling the operation of the driving transistor DRT.

The sensing transistor SENT is electrically connected between the second node N2 of the driving transistor DRT and the reference voltage line RVL, and the gate line GL is connected to the gate node. The sensing transistor SENT is operated according to the sense signal SENSE supplied through the gate line GL. When the sensing transistor SENT is turned on, a reference voltage Vref supplied through the reference voltage line RVL is transferred to the second node N2 of the driving transistor DRT.

In other words, as the switching transistor SWT and the sensing transistor SENT are controlled, the voltage of the first node N1 and the voltage of the second node N2 of the driving transistor DRT are controlled, so that the current for driving the light emitting element ED may be supplied.

The gate nodes of the switching transistor SWT and the sensing transistor SENT may be commonly connected to one gate line GL or may be connected to different gate lines GL. An example is shown in which the switching transistor SWT and the sensing transistor SENT are connected to different gate lines GL in which case the switching transistor SWT and the sensing transistor SENT may be independently controlled by the scan signal SCAN and the sense signal SENSE transferred through different gate lines GL.

In contrast, if the switching transistor SWT and the sensing transistor SENT are connected to one gate line GL, the switching transistor SWT and the sensing transistor SENT may be simultaneously controlled by the scan signal SCAN or sense signal SENSE transferred through one gate line GL, and the aperture ratio of the subpixel SP may be increased.

The transistor disposed in the subpixel SP may be an n-type transistor or a p-type transistor and, in the shown example, the transistor is an n-type transistor.

The storage capacitor Cst is electrically connected between the first node N1 and second node N2 of the driving transistor DRT and maintains the data voltage Vdata during one frame.

The storage capacitor Cst may also be connected between the first node N1 and third node N3 of the driving transistor DRT depending on the type of the driving transistor DRT. The anode electrode of the light emitting element ED may be electrically connected with the second node N2 of the driving transistor DRT, and a base voltage EVSS may be applied to the cathode electrode of the light emitting element ED.

The base voltage EVSS may be a ground voltage or a voltage higher or lower than the ground voltage. The base voltage EVSS may be varied depending on the driving state. For example, the base voltage EVSS at the time of display driving and the base voltage EVSS at the time of sensing driving may be set to differ from each other.

The structure of the subpixel SP described above as an example is a 3T (transistor) 1C (capacitor) structure, which is merely an example for description, and may further include one or more transistors or, in some cases, one or more capacitors. The plurality of subpixels SP may have the same structure, or some of the plurality of subpixels SP may have a different structure.

To effectively sense a characteristic value, e.g., threshold voltage or mobility, of the driving transistor DRT, the display device 100 according to embodiments of the disclosure may use a method for measuring the current flowed by the voltage charged to the storage capacitor Cst during a characteristic value sensing period of the driving transistor DRT, which is called current sensing.

In other words, it is possible to figure out the characteristic value, or a variation in characteristic value, of the driving transistor DRT in the subpixel SP by measuring the current flowed by the voltage charged to the storage capacitor Cst during the characteristic value sensing period of the driving transistor DRT.

In this case, the reference voltage line RVL serves not only to transfer the reference voltage Vref but also as a sensing line for sensing the characteristic value of the driving transistor DRT in the subpixel SP. Thus, the reference voltage line RVL may also be referred to as a sensing line.

In this case, the period for sensing the driving characteristic values (threshold voltage and mobility) of the driving transistor DRT may be performed after the power-on signal is generated and before the display driving starts. For example, if a power-on signal is applied to the display device 100, the timing controller 140 loads parameters beneficial for driving the display panel 110 and then drives the display. In this case, the parameters beneficial for driving the display panel 110 may include information about the sensing and compensation for driving characteristic values previously performed on the display panel 110. In the parameter loading process, the sensing of driving characteristic values (threshold voltage and mobility) of the driving transistor DRT may be performed. As described above, a process in which the driving characteristic value is sensed in the parameter loading process after the power-on signal is generated is referred to as an on-sensing process.

Alternatively, a period in which the driving characteristic value of the driving transistor DRT is sensed may proceed after a power-off signal of the display device 100 is generated. For example, when a power-off signal is generated in the display device 100, the timing controller 140 may cut off the data voltage supplied to the display panel 110 and may sense the driving characteristic value of the driving transistor DRT for a predetermined or selected time. As such, a process in which a driving characteristic value is sensed in a state in which the data voltage is cut off as a power-off signal is generated is referred to as an off-sensing process.

Alternatively, the sensing period for the driving characteristic value of the driving transistor DRT may be performed in real time while the display is driven. This sensing process is referred to as a real-time (RT) sensing process. In the real-time sensing process, the sensing process may be performed on one or more subpixels SP in one or more subpixel SP lines, each blank period during the display driving period.

Figure 4:
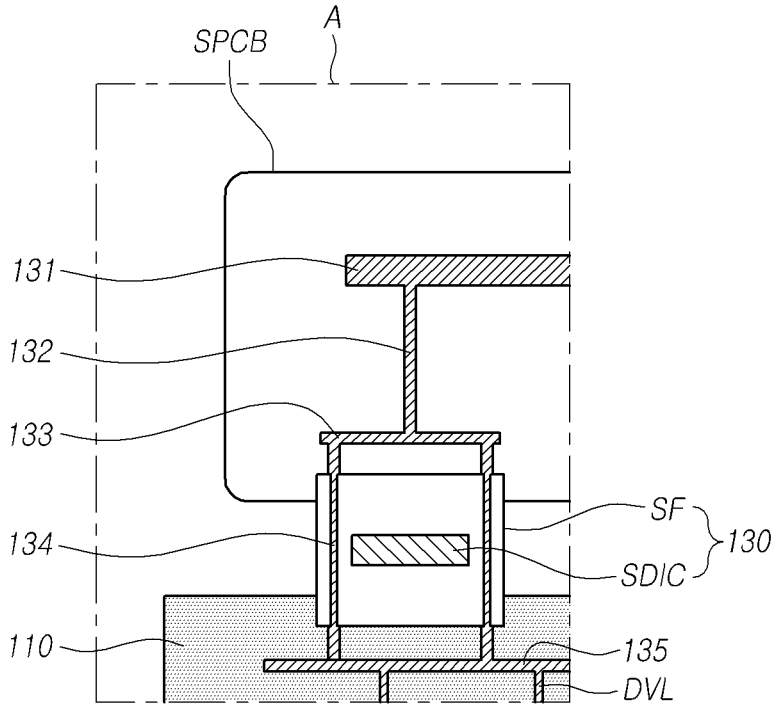
FIG. 4 is a view illustrating an example of a transfer path of a driving voltage in a display device according to embodiments of the disclosure.

FIG. 4 is a view illustrating an example of a transfer path of a driving voltage in a display device according to embodiments of the disclosure. Here, portion A shown in FIG. 2 is enlarged and illustrated.

Referring to FIG. 4, in the display device 100 according to embodiments of the disclosure, a plurality of subpixels SP defined by (e.g., positioned at regions of overlaps of) a plurality of data lines DL and a plurality of gate lines GL crossing each other are disposed on the display panel 110. In this case, each subpixel SP receives the driving voltage EVDD through a plurality of driving voltage lines DVL arranged in a direction parallel to the plurality of data lines DL.

The plurality of driving voltage lines DVL may be formed between the plurality of data lines DL to be parallel to the plurality of data lines DL or may be formed to be shared by two subpixels adjacent to each other in the left and right directions.

The plurality of driving voltage lines DVL may be commonly connected to the common driving voltage line 135 formed in the upper non-display area of the display panel 110.

The driving voltage EVDD transferred from the power management circuit 150 is supplied to the common driving voltage line 135 through the plurality of data driving circuits 130.

To transfer the driving voltage EVDD to the plurality of driving voltage lines DVL, a first driving voltage supply line 131, a second driving voltage supply line 132, a third driving voltage supply line 133, and a fourth driving voltage supply line 134 may be disposed.

The first driving voltage supply line 131, the second driving voltage supply line 132, and the third driving voltage supply line 133 may be electrically connected to the source printed circuit board SPCB.

The fourth driving voltage supply line 134 may be branched to two opposite sides of the source driving integrated circuit SDIC in the data driving circuit 130 and may electrically connect the third driving voltage supply line 133 with the common driving voltage line 135.

The third driving voltage supply line 133 may be disposed in an area adjacent to the source film SF and may be electrically connected to the fourth driving voltage supply line 134 formed in the data driving circuit 130.

Since the first driving voltage supply line 131 corresponds to a portion to which the driving voltage EVDD supplied from the power management circuit 150 is applied, the first driving voltage supply line 131 may be formed to have a relatively larger area than the third driving voltage supply line 133.

The second driving voltage supply line 132 may be branched from the first driving voltage supply line 131 to have a predetermined or selected interval and is connected to the third driving voltage supply line 133.

In this case, since the second driving voltage supply line 132 is positioned in an area before the driving voltage EVDD is branched through the plurality of driving voltage lines DVL, the second driving voltage supply line 132 has a relatively high current density as compared to the fourth driving voltage supply line 134 and the driving voltage line DVL.

Accordingly, the second driving voltage supply line 132 has a high chance of an increase in temperature and a defect due to the high-density current.

Meanwhile, the data driving circuit 130 may form several source driving integrated circuits SDIC into a group to supply the driving voltage EVDD on a per-group basis.

In this case, the driving voltage EVDD output from the power management circuit 150 undergoes a voltage drop (e.g., an IR drop) due to the resistance component of the line while being transferred through the driving voltage supply lines 131, 132, 133, and 134 and the driving voltage line DVL.

Figure 5:
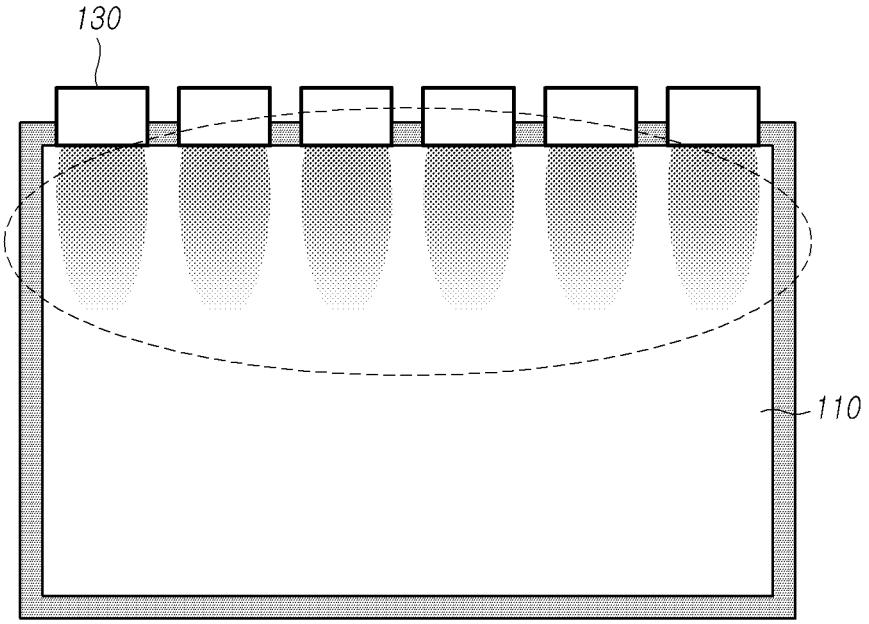
FIG. 5 is a view illustrating an example in which image non-uniformity occurs in a display panel due to a voltage drop in a driving voltage.

FIG. 5 is a view illustrating an example in which image non-uniformity occurs in a display panel due to a voltage drop of a driving voltage.

Referring to FIG. 5, in the display device 100, the driving voltage EVDD transferred through the driving voltage line DVL may undergo a voltage drop due to the resistance component of the driving voltage line DVL and, if the drop in the driving voltage EVDD differs depending on the position, non-uniformity may occur in the image displayed on the display panel 110.

In particular, if such image non-uniformity is a predetermined or selected reference or more, a quality defect may be perceived by the user's eyes.

In this case, the image non-uniformity due to a voltage drop of the driving voltage may occur in the position of the data driving circuit 130 where the driving voltage supply lines 131, 132, 133, and 134 are disposed.

In other words, the driving voltage supply lines 131, 132, 133, and 134 are disposed through each source film SF where the source driving integrated circuit SDIC is mounted in the data driving circuit 130, and the line resistance varies depending on the path of the driving voltage line DVL extending therefrom. Thus, image non-uniformity may occur.

Accordingly, while the driving voltage line DVL in the area which overlaps the data driving circuit 130 in the extending direction of the driving voltage line DVL in the display panel forms a relatively short path, the driving voltage line DVL in the area which does not overlap the data driving circuit 130 forms a relatively long path.

As a result, a difference in voltage drop between the driving voltage line DVL positioned in the area overlapping the data driving circuit 130 and the driving voltage line DVL positioned in the area not overlapping the data driving circuit 130 occurs, causing image non-uniformity.

The display device 100 according to embodiments of the disclosure may compensate for the data voltage Vdata considering the voltage drop of the driving voltage EVDD in the first direction where the data driving circuits 130 are arranged, depending on the position, based on whether it overlaps the data driving circuit 130, thereby enhancing the uniformity of the image displayed on the display panel 110.

Figure 6:
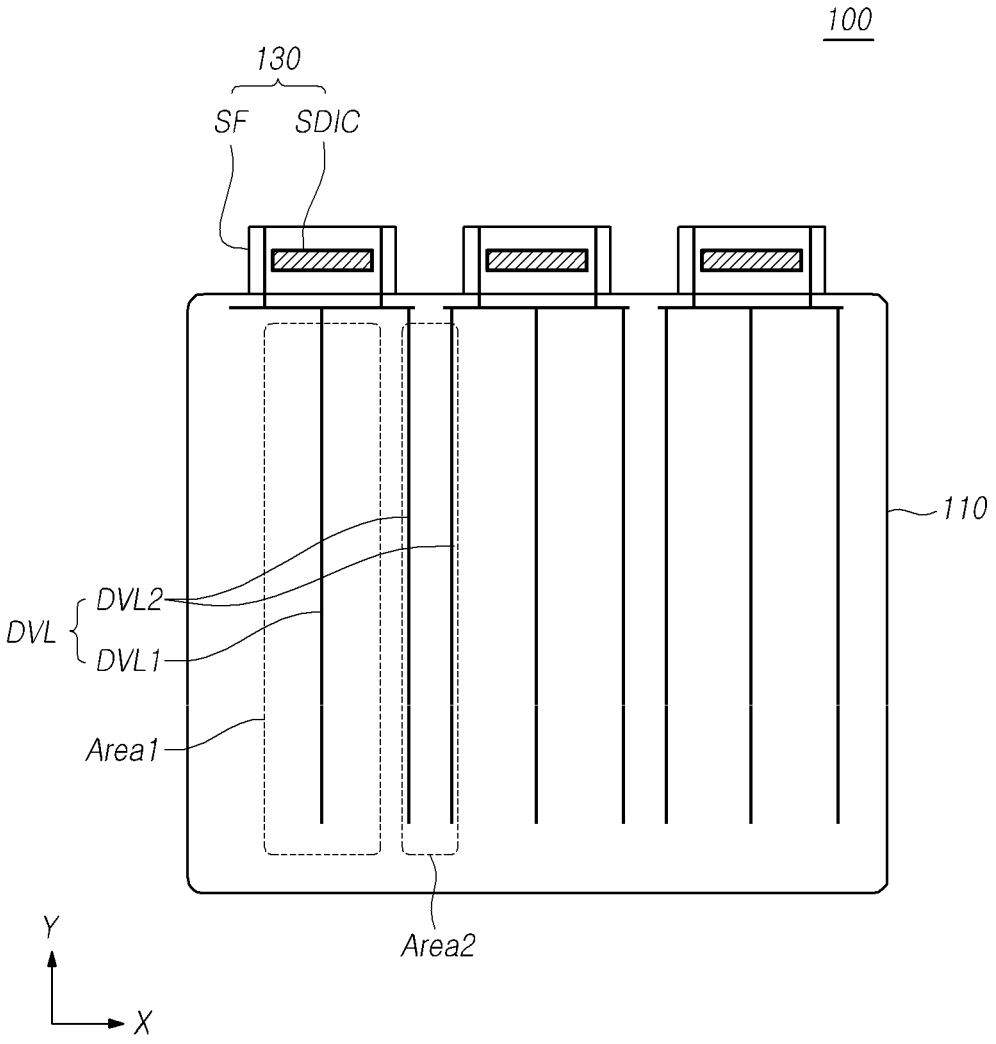
FIG. 6 is a view illustrating an example of a concept of differentially compensating for a voltage drop in a driving voltage with respect to a first direction in a display device according to embodiments of the disclosure.

FIG. 6 is a view illustrating an example of a concept of differentially compensating for a voltage drop in a driving voltage with respect to a first direction in a display device according to embodiments of the disclosure.

Referring to FIG. 6, the display device 100 according to embodiments of the disclosure may compensate for the data voltage Vdata considering the voltage drop of the driving voltage EVDD in the first direction where the data driving circuits 130 are arranged, depending on the position, based on whether it overlaps the data driving circuit 130, thereby enhancing image uniformity.

The first direction is a direction in which a plurality of data driving circuits 130 are arranged on the display panel 110 and, if the plurality of data driving circuits 130 are arranged in the horizontal direction as shown in FIG. 6, the first direction corresponds to the horizontal direction.

Accordingly, the subpixels SP arranged in the first direction which is the horizontal direction are divided depending on whether they correspond to the overlapping area (or "first area") of the data driving circuit 130 or the non-overlapping area (or "second area") of the data driving circuit 130, and a different compensation value for the supplied data voltage Vdata is applied to each area, so that the image uniformity may be enhanced.

In this case, the overlapping area Area1 corresponding to the data driving circuit 130 may be an area corresponding to the position overlapping the data driving circuit 130 in the extending direction of the driving voltage line DVL, e.g., the second direction perpendicular to the first direction.

Accordingly, since the overlapping area Area1 corresponding to the data driving circuit 130 corresponds to the position overlapping the data driving circuit 130 in the second direction along which the driving voltage line DVL extends, the first driving voltage line DVL1 disposed in the overlapping area Area1 corresponding to the data driving circuit 130 may be formed in a linear structure from the data driving circuit 130.

The non-overlapping area Area2 not corresponding to the data driving circuit 130 may be an area corresponding to the position not overlapping the data driving circuit 130 in the second direction along which the driving voltage line DVL extends. The non-overlapping area Area2 not corresponding to the data driving circuit 130 may correspond to an area corresponding to a space between data driving circuits 130 adjacent to each other in the second direction. It should be understood that overlapping areas Area1 and non-overlapping areas Area2 may extend in the second direction (e.g., the Y-axis direction), and may be arranged in the first direction (e.g., the X-axis direction). The overlapping areas Area1 may be understood as projections of and extending from the data driving circuits 130 (e.g., the extension being in the second direction), and the non-overlapping areas Area2 may be understood as projections of and extending from the spaces between the data driving circuits 130 (e.g., the extension being in the second direction).

Accordingly, since the non-overlapping area Area2 not corresponding to the data driving circuit 130 corresponds to the position not overlapping the data driving circuit 130 in the second direction along which the driving voltage line DVL extends, the second driving voltage line DVL2 disposed in the non-overlapping area Area2 not corresponding to the data driving circuit 130 may be formed in a structure bent from the data driving circuit 130.

Accordingly, the second driving voltage line DVL2 disposed in the non-overlapping area Area2 that does not correspond to the data driving circuit 130 may have a relatively long line path as compared with the first driving voltage line DVL1 disposed in the overlapping area Area1 corresponding to the data driving circuit 130.

As a result, the voltage drop generated through the second driving voltage line DVL2 disposed in the non-overlapping area Area2 not corresponding to the data driving circuit 130 is relatively larger than the voltage drop generated through the first driving voltage line DVL1 disposed in the overlapping area Area1 corresponding to the data driving circuit 130. It should be understood that "bent" may include the meaning that a driving voltage line includes a horizontal segment (e.g., in the X-axis direction) connected to a vertical segment (e.g., in the Y-axis direction). For example, the second driving voltage line DVL2 includes a horizontal segment that extends past the data driving circuit 130 and attaches to the vertical segment that extends through the non-overlapping area Area2. Such a horizontal segment may not be present in the first driving voltage lines DVL1, such that the second driving voltage lines DVL2 have an additional voltage drop (or "IR drop") due to the horizontal segment.

Accordingly, the display device 100 of the disclosure may enhance the uniformity of the image displayed in the first direction by reducing the first compensation gain of the data voltage Vdata for the subpixels SP positioned in the overlapping area Area1 of the data driving circuit 130 while increasing or maintaining the first compensation gain of the data voltage Vdata for subpixels SP positioned in the non-overlapping area Area2 of the data driving circuit 130, for the subpixels SP in the first direction. For example, a first value of the first compensation gain may be associated with the subpixels SP positioned in the overlapping area Area1, and a second value of the first compensation gain may be associated with the subpixels SP positioned in the non-overlapping area Area2. The second value may be greater than the first value.

Further, the display device 100 of the disclosure may enhance the uniformity of the image displayed on the display panel 110 by compensating for the data voltage Vdata by applying the second compensation gain differently along the second direction perpendicular to the first direction depending on the magnitude of the drop in the driving voltage EVDD depending on position along the driving voltage line DVL.

Figure 7:
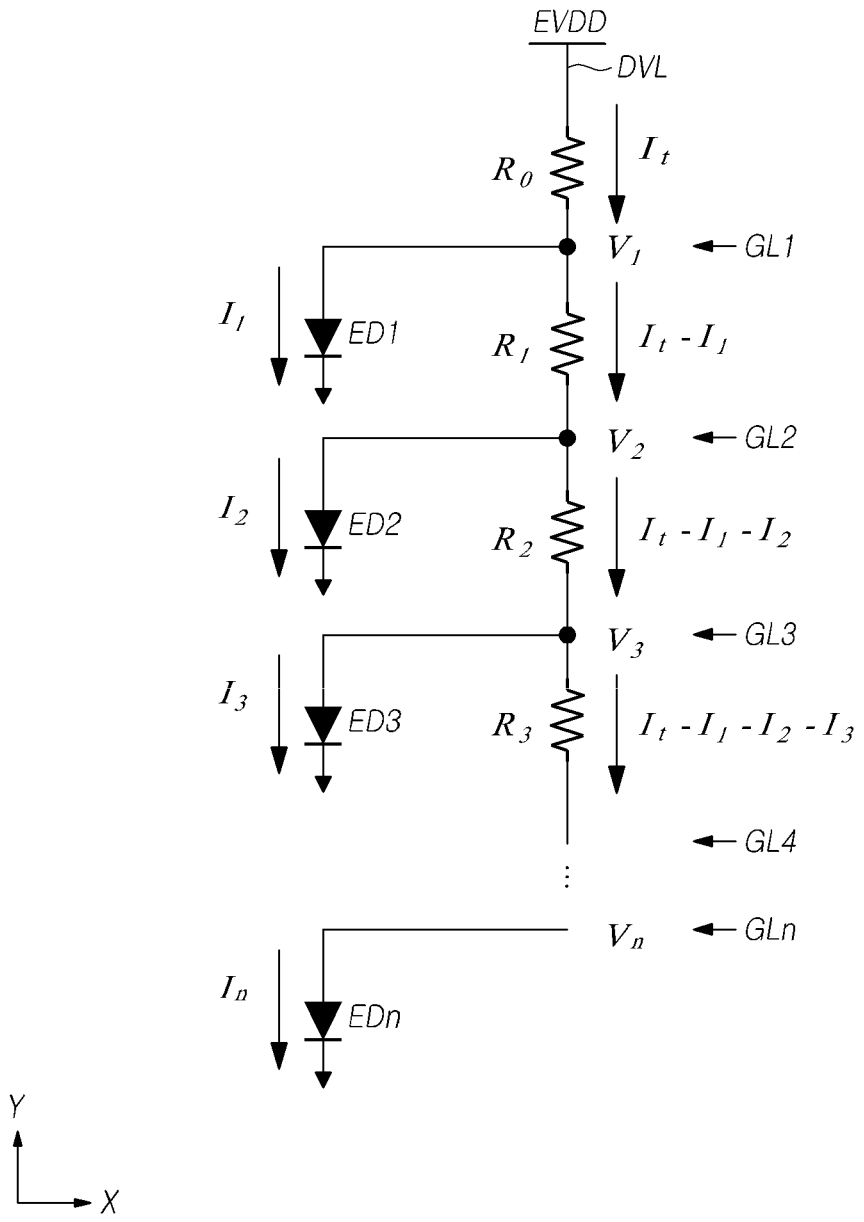
FIG. 7 is a view illustrating a concept of a voltage drop in a second direction along which a driving voltage line extends in a display device according to embodiments of the disclosure.

FIG. 7 is a view illustrating a concept of a voltage drop in a second direction along which a driving voltage line extends in a display device according to embodiments of the disclosure.

Referring to FIG. 7, in the display device 100 according to embodiments of the disclosure, the driving current flowed through the driving voltage line DVL by the driving voltage EVDD is reduced by the line resistance of the driving voltage line DVL.

In this case, the resistance component of the driving voltage line DVL may be divided with respect to the overlap with the gate line GL. Accordingly, the resistance component between the node which the driving voltage EVDD is led in and the first gate line GL1 may be referred to as a lead-in resistor R0, the resistance component between the first gate line GL1 and the second gate line GL2 may be referred to as a first resistor R1, the resistance component between the second gate line GL2 and the third gate line GL3 may be referred to as a second resistor R2, and the resistance component between the third gate line GL3 and the fourth gate line GL4 may be referred to as a third resistor R3.

The lead-in current It flowing through the lead-in resistor R0 is branched into a first light emitting current I1 flowing to the first light emitting element ED1 through the first gate line GL1 and a driving current It−I1 flowing to the first resistor R1.

Accordingly, the first driving voltage V1 corresponding to the first gate line GL1 may be calculated as EVDD−R0*It.

The driving current It−I1 flowing through the first resistor R1 is branched into a second light emitting current I2 flowing through the second gate line GL2 to the second light emitting element ED2 and the driving current It-I1-I2 flowing through the second resistor R2.

Accordingly, the second driving voltage V2 corresponding to the second gate line GL2 may be calculated as V1−R1*(It−I1).

The driving currents It-I1-I2 flowing through the second resistor R2 is branched into a third light emitting current I3 flowing through the third gate line GL3 to the third light emitting element ED3 and a driving current It-I1-I2-I3 flowing through the third resistor R3.

Accordingly, the third driving voltage V3 corresponding to the third gate line GL3 may be calculated as V2−R2*(It−I1−I2).

As such, the level of the driving voltage at the overlap of the driving voltage line DVL and each gate line GL may be calculated. Accordingly, the voltage drop according to the position of the driving voltage line DVL is calculated using the driving voltage level at the overlap with each gate line GL, and the compensation value of the data voltage Vdata corresponding thereto may be determined.

Further, since the voltage drop of the driving voltage line DVL may be varied depending on the pattern of the input image in the display device 100 of the disclosure, it is possible to effectively enhance the image uniformity according to the image pattern by setting a different second compensation gain for the data voltage Vdata depending on the pattern of the input image.

FIG. 8 is a view illustrating an example of setting a different compensation gain of a data voltage depending on a pattern of an input image in a display device according to embodiments of the disclosure.

Referring to FIG. 8, in the display device 100 according to embodiments of the disclosure, the magnitude of the voltage drop of the driving voltage line DVL may vary depending on the pattern of the input image.

For example, if the input image is black data of grayscale 0, the degree of voltage drop between the first gate line GL1 and the nth gate line GLn may be small and, if the input image is white data of grayscale 255, the degree of voltage drop between the first gate line GL1 and the nth gate line GLn may be large.

The closer to the white grayscale, the higher luminance of data voltage Vdata is applied. Thus, the temperature of the display panel 110 may increase, or the voltage drop of the driving voltage line DVL may be increased due to the operation characteristics of the circuit element driving the display panel 110.

Accordingly, to compensate for an increase in the voltage drop of the driving voltage line DVL as the grayscale of the input image increases, the difference between the second compensation gain of the gate line (e.g., the first gate line GL1) close to the data driving circuit 130 and the second compensation gain for the data voltage Vdata applied to a gate line (e.g., the nth gate line GLn) far away from the data driving circuit 130 may be set to be larger as the grayscale of the input image increases. For example, the second compensation gain may have a first value associated with the gate line close to the data driving circuit 130, and may have a second value associated with the gate line far away from the data driving circuit 130, the second value being greater than the first value.

In contrast, if the grayscale of the input image is small, the voltage drop of the driving voltage line DVL is relatively small. The difference between the second compensation gain of the gate line (e.g., the first gate line GL1) close to the data driving circuit 130 and the second compensation gain for the data voltage Vdata applied to a gate line (e.g., the nth gate line GLn) far away from the data driving circuit 130 may be set to be small.

For example, if black data of grayscale 0 is input, a relatively small voltage drop occurs between the first gate line GL1 and the nth gate line GLn. Thus, the second compensation gain of the first gate line GL1 and the second compensation gain of the nth gate line GLn have merely a difference (16/256) between 240/256 and 256/256. However, if white data of grayscale 255 is input, the second compensation gain of the first gate line GL1 and the second compensation gain of the nth gate line GLn may have a difference (48/256) between 208/256 and 256/256.

Accordingly, the compensation value of the data voltage Vdata for the second direction in which the driving voltage line DVL extends may set a different difference in second compensation gain for the subpixel SP corresponding to the gate line GL depending on the pattern of the input image, e.g., the grayscale of the input image.

The second compensation gain of the data voltage Vdata applied to the subpixel SP corresponding to each gate line GL for each grayscale of the input image is shown as an example.

For example, if an image of grayscale 0 is input, a second compensation gain of 240/256 may be applied to the subpixel SP corresponding to the first gate line GL1, and a second compensation gain of 256/256 may be applied to the subpixel SP corresponding to the nth gate line GLn.

In contrast, if an image of grayscale 255 is input, a second compensation gain of 208/256 may be applied to the subpixel SP corresponding to the first gate line GL1, and a second compensation gain of 256/256 may be applied to the subpixel SP corresponding to the nth gate line GLn.

The second compensation gain data (e.g., the first value and the second value) of the data voltage Vdata according to such an input image pattern may be stored in the memory in the form of a lookup table. For example, the lookup table may associate each of the subpixels SP or each of the gate lines GL1–GLn of the display panel 110 with a value of the second compensation gain. The lookup table may associate each of the subpixels SP or each of the gate lines GL1–GLn with a different value of the second compensation gain for each grayscale value (e.g., different values for 0G, 16G, 32G, . . . 255G). One or more of the different values may have the same magnitude, for example, when the difference between the second compensation gain of the first gate line GL1 and the second compensation gain of the nth gate line GLn is 16/256 (e.g. 256/256-240/256), and the number "n" is in the thousands. In one embodiment, the lookup table associates each of the subpixels SP or each of the gate lines GL1–GLn with a different value of the second compensation gain for every grayscale value (e.g., different values for 0G, 1G, 2G, 3G, . . . 255G).

Figure 9:
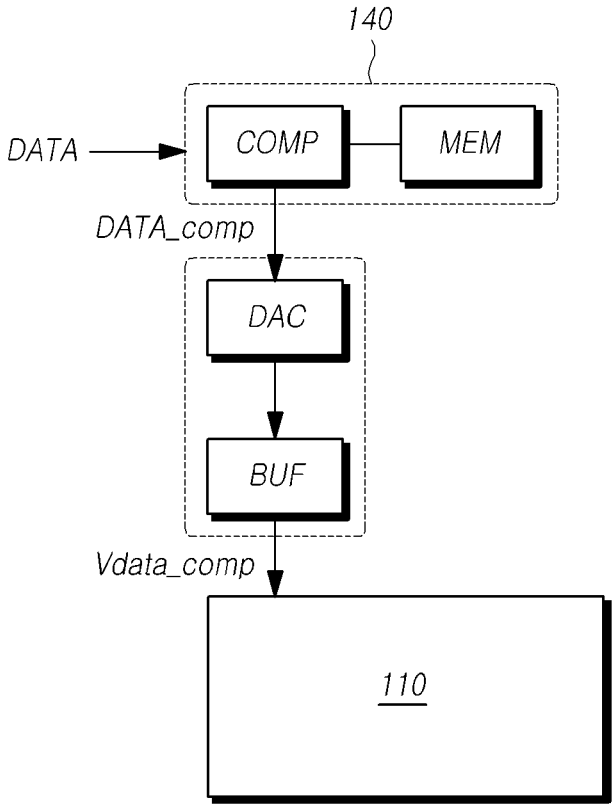
FIG. 9 is a view schematically illustrating a process for compensating for a data voltage applied to a display panel in a display device according to embodiments of the disclosure.

FIG. 9 is a view schematically illustrating a process for compensating for a data voltage applied to a display panel in a display device according to embodiments of the disclosure.

Referring to FIG. 9, a display device 100 according to embodiments of the disclosure may include components for compensating for a deviation in driving voltage EVDD depending on the position in the display panel 110.

For example, during a display driving period during which the driving voltage EVDD is applied, the display device 100 may determine a first compensation gain considering a position corresponding to the data driving circuit 130 to a first direction in which the data driving circuits 130 are disposed on the display panel 110 and determine a second compensation gain of the data voltage Vdata considering a voltage drop of the driving voltage EVDD determined according to the two-dimensional position including a second direction in which the driving voltage line DVL extends.

The timing controller 140 of the display device 100 may include a memory MEM for storing the first compensation gain and the second compensation gain determined according to the two-dimensional position of the display panel 110 and a compensation circuit COMP for compensating for a deviation in driving voltage EVDD according to the two-dimensional position of the display panel 110 according to the first compensation gain or second compensation gain stored in the memory MEM.

Accordingly, the compensation circuit COMP of the timing controller 140 may compensate for the image data DATA to be supplied to the data driving circuit 130, corresponding to the individual position of the display panel 110 using the first compensation gain or second compensation gain extracted from the memory MEM and output the compensated image data DATA_comp to the data driving circuit 130.

Accordingly, the data driving circuit 130 may convert the compensated image data DATA_comp into an analog signal type of compensated data voltage Vdata_comp through a digital-to-analog converter DAC and transmit the compensated data voltage Vdata_comp to the data line DL through an output buffer BUF. As a result, it is possible to compensate for the deviation in driving voltage EVDD for the subpixel SP according to the two-dimensional position of the display panel 110.

The compensation circuit COMP may be present inside or outside the timing controller 140. The memory MEM may be positioned outside the timing controller 140 or may be implemented, in the form of a register, inside the timing controller 140.

Figure 10:
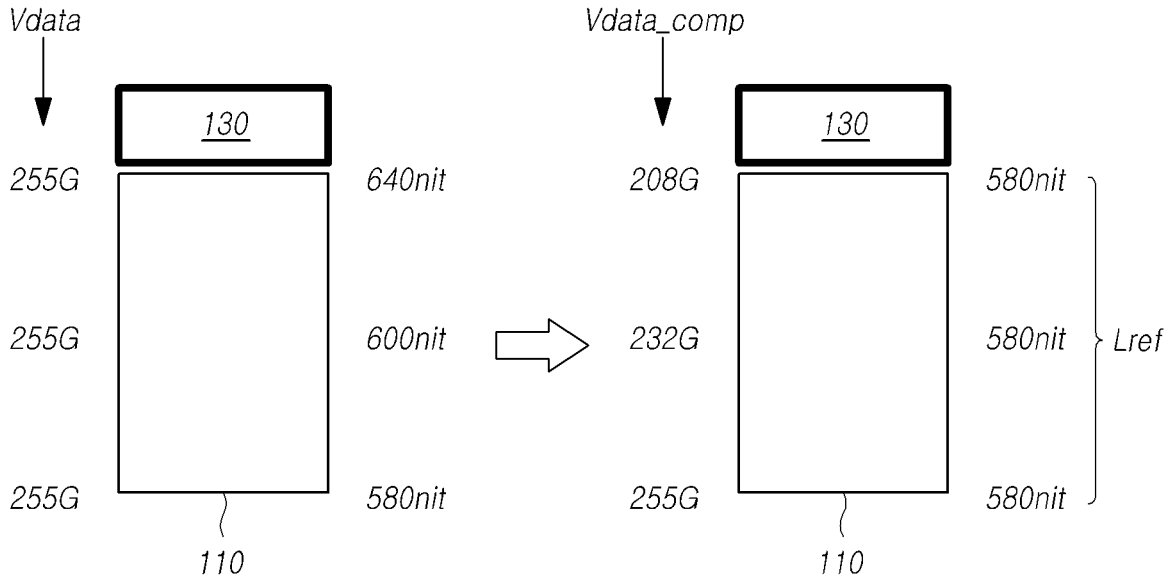
FIGS. 10 and 11 are views illustrating an example in which a display device varies a second compensation gain of a data voltage depending on a position in a second direction considering an input image pattern according to embodiments of the disclosure.
Figure 11:
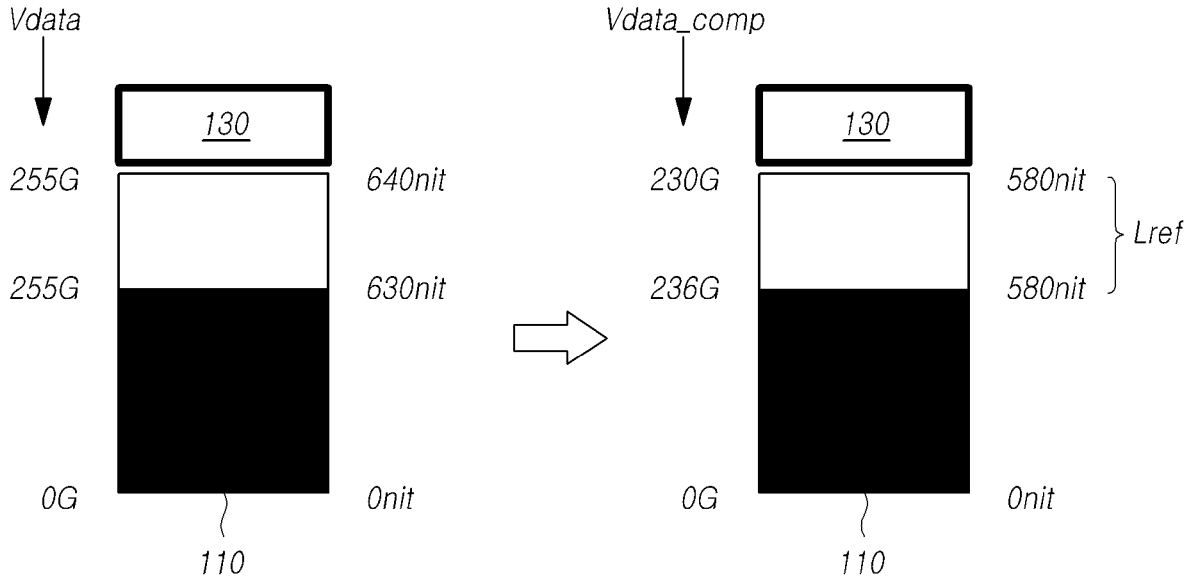

FIGS. 10 and 11 are views illustrating an example in which a display device varies a second compensation gain of a data voltage depending on a position in a second direction by applying an input image pattern according to embodiments of the disclosure.

Referring to FIG. 10, the display device 100 according to embodiments of the disclosure may receive white data of grayscale 255 (255G) as image data DATA.

Accordingly, the data driving circuit 130 supplies the data voltage Vdata of grayscale 255 (255G) to the display panel 110. However, the driving voltage EVDD transferred through the driving voltage line DVL extending from the data driving circuit 130 to the display panel 110 undergoes a voltage drop due to the line resistance. Thus, the light emitting luminance decreases as it goes further away from the data driving circuit 130.

For example, the subpixel SP disposed in the position close to the data driving circuit 130 exhibits a luminance of 640 nit by the data voltage Vdata of grayscale 255 (255G) while the subpixel SP disposed in the position far away from the data driving circuit 130 may exhibit a luminance of 580 nit due to the voltage drop of the driving voltage line DVL.

To compensate for the deviation in the driving voltage EVDD, the display device 100 may apply the compensated data voltage Vdata_comp according to the position for the second direction of the display panel 110 considering the voltage drop of the driving voltage line DVL according to the image pattern of grayscale 255, thereby uniformly compensating for the light emitting luminance of the display panel 110 to a reference luminance Lref.

As the second compensation gain for generating the compensated data voltage Vdata_comp, a value determined for the white data of grayscale 255 (255G) in the table of FIG. 8 may be used.

In this case, the timing controller 140 may extract, from the memory MEM, the luminance value (e.g., grayscale 208 (208G)) of the light emission in the position farthest from the data driving circuit 130 due to the voltage drop of the driving voltage EVDD according to the image pattern and determine it as a reference grayscale value of the compensated data voltage Vdata_comp.

In other words, if the white data of grayscale 255 (255G) is applied, the subpixel SP in the position farthest from the data driving circuit 130 exhibits grayscale 208 (208G). Thus, the second compensation gain may be applied so that the compensated data voltage Vdata_comp of grayscale 208 (208G) is uniformly applied to all the subpixels SP of the display panel 110 considering the voltage drop of the driving voltage EVDD.

In other words, the second compensation gain of 208/256 is applied so that the compensated data voltage Vdata_comp of grayscale 208 (208G) is applied to the subpixel SP close to the data driving circuit 130 in the display panel 110. The second compensation gain of 232/256 may be applied so that the compensated data voltage Vdata_comp of grayscale 232 (232G) is applied to an intermediate area, and the second compensation gain of 256/256 may be applied so that the compensated data voltage Vdata_comp of grayscale 255 (255G) is applied to an area far away from the data driving circuit 130.

As a result, the compensated data voltage Vdata_comp of grayscale 208 (208G) reaches the subpixels SP positioned in the intermediate area and the area far away from the data driving circuit 130 like the subpixels SP close to the data driving circuit 130, due to the voltage drop in driving voltage EVDD, so that the entire display panel 110 emits light in the same reference luminance Lref (580 nit).

In this case, the reference luminance Lref presented by the display panel 110 by the compensated data voltage Vdata_comp may be determined considering the input image pattern or may be changed by settings. For example, the reference luminance Lref may be selected (e.g., by a manufacturer, a user, or the like).

Further, the display device 100 of the disclosure may determine the compensated data voltage Vdata_comp considering image data DATA of an intermediate grayscale, if inputted, as well as the white data of grayscale 255 (255G) and the black data of grayscale 0.

Referring to FIG. 11, in the display device 100 according to embodiments of the disclosure, image data DATA corresponding to an intermediate grayscale between grayscale 0 and grayscale 255 may be input.

For example, one-frame image data DATA may include a black area where grayscale 0 black data is applied and a white area where grayscale 255 white data is applied and may have average grayscale equal to grayscale 32 (e.g., value "32G" of FIG. 8).

Accordingly, the data driving circuit 130 may be operated so that the data voltage Vdata of grayscale 255 (255G) is applied to the white area, and the data voltage Vdata of grayscale 0 (0G) is applied to the black area. However, the driving voltage EVDD transferred through the driving voltage line DVL extending from the data driving circuit 130 to the display panel 110 undergoes a voltage drop due to the line resistance. Thus, the light emitting luminance decreases as it goes further away from the data driving circuit 130.

For example, the data voltage Vdata of grayscale 255 (255G) may be applied to the white area formed in a position close to the data driving circuit 130 and, in the white area, the subpixel SP closest to the data driving circuit 130 may exhibit a luminance of 640 nit, and the subpixel SP in the position farthest from the data driving circuit 130 in the white area may exhibit a luminance of 630 nit due to a voltage drop of the driving voltage EVDD.

Since the data voltage Vdata of grayscale 0 (0G) is applied to the black area formed in the position farthest from the data driving circuit 130, the black area may exhibit a luminance of 0 nit.

The one-frame identified may constitute average grayscale equal to grayscale 32 due to the white area and the black area.

In this case, since image non-uniformity occurs in the white area, compensated data voltage Vdata_comp may be applied only to the white area to compensate for the voltage drop of the driving voltage EVDD while the compensated data voltage Vdata_comp of grayscale 0 (0G) may be applied to the black area.

In other words, for an image pattern of an intermediate grayscale, the display device 100 may apply the compensated data voltage Vdata_comp according to the position to the second direction of the white area of the display panel 110 considering the voltage drop of the driving voltage line DVL according to the image pattern of the intermediate grayscale, thereby uniformly compensating for the light emitting luminance of the display panel 110 to a reference luminance Lref.

Given the case where the second compensation gain is used for the image data of the intermediate grayscale (e.g., grayscale 32 (32G)) in the table of FIG. 8, the timing controller 140 may extract, from the memory MEM, the luminance value (e.g., grayscale 230 (230G)) of the light emission in the position farthest from the data driving circuit 130 due to the voltage drop of the driving voltage EVDD according to the image pattern and determine it as a reference grayscale value of the compensated data voltage Vdata_comp.

In other words, in a case where the image data of grayscale 32 (32G) is applied, if the subpixel SP in the position farthest from the data driving circuit 130 exhibits grayscale 230 (230G), control may be performed so that the compensated data voltage Vdata_comp of grayscale 230

(230G) is applied to all the subpixels SP of the display panel 110 considering the voltage drop of the driving voltage EVDD.

In other words, the second compensation gain of 230/256 is applied so that the compensated data voltage Vdata_comp of grayscale 230 (230G) is applied to the subpixel SP close to the data driving circuit 130 in the display panel 110. The second compensation gain of 236/256 is applied so that the compensated data voltage Vdata_comp of grayscale 236 (236G) is applied to the intermediate area where the white area and the black area touch.

A compensation data voltage Vdata_comp of grayscale 0 (0G) may be applied to the black area to which the black data of grayscale 0 is applied.

As a result, the compensated data voltage Vdata_comp of grayscale 230 (230G) reaches the subpixel SP positioned in the white area, so that the white area in the display panel 110 emits light in the same reference luminance Lref (580 nit).

In this case, the reference luminance Lref presented by the display panel 110 by the compensated data voltage Vdata_comp may be determined considering the input image pattern or may be changed by settings. For example, the reference luminance Lref may be selected (e.g., by a manufacturer, a user, or the like).

As such, the display device 100 of the disclosure may determine the first compensation data voltage, considering the voltage drop of the driving voltage EVDD varying depending on the position corresponding to the data driving circuit 130 in the first direction in which the data driving circuits 130 are arranged.

Then, the display device 100 may determine the second compensation data voltage considering the voltage drop of the driving voltage EVDD varying depending on the resistance component of the driving voltage line DVL in the second direction of the display panel 110 in which the driving voltage line DVL extends.

Thus, it is possible to mitigate luminance non-uniformity depending on the two-dimensional position of the subpixel SP considering both the voltage drop in the first direction and the voltage drop in the second direction of the display panel 110.

Figure 12:
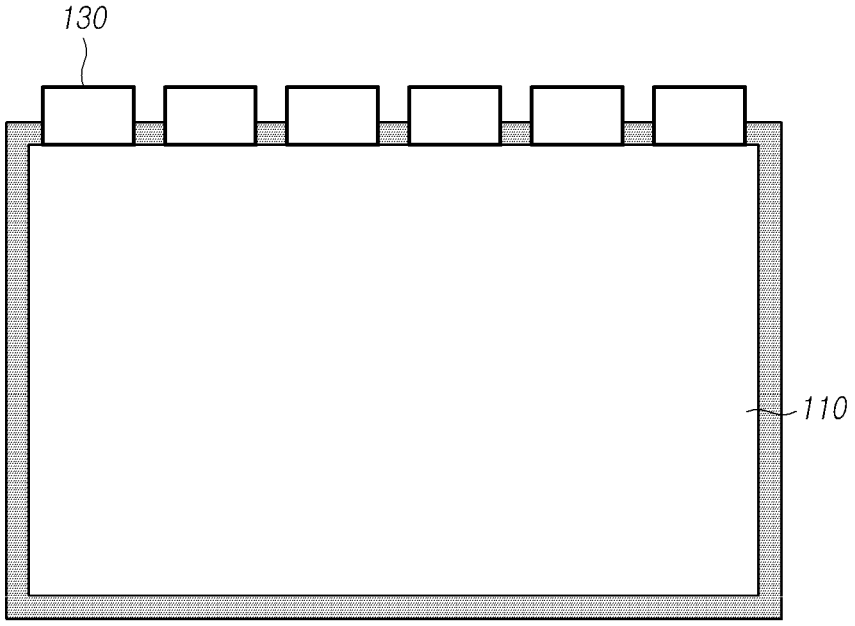
FIG. 12 is a view illustrating an example of enhancing luminance uniformity by compensating for a data voltage considering a voltage drop in a driving voltage which varies depending on the two-dimensional position of the subpixel in a display panel in a display device according to embodiments of the disclosure.

FIG. 12 is a view illustrating an example of enhancing luminance uniformity by compensating for a data voltage by applying a voltage drop in a driving voltage which varies depending on the two-dimensional position of the subpixel in a display panel in a display device according to embodiments of the disclosure.

Referring to FIG. 12, the display device 100 according to embodiments of the disclosure may mitigate luminance non-uniformity depending on the two-dimensional position of the subpixel SP, considering the voltage drop of the driving voltage EVDD varying depending on the position corresponding to the data driving circuit 130 in the first direction of the display panel 110 and the voltage drop of the driving voltage EVDD varying depending on the resistance component of the driving voltage line DVL in the second direction of the display panel 110.

In particular, the display device 100 according to embodiments of the disclosure may effectively mitigate luminance non-uniformity depending on the two-dimensional position of the subpixel SP considering the voltage drop of the driving voltage EVDD varying depending on the pattern of input image data in the second direction of the display panel 110.

Figure 13:
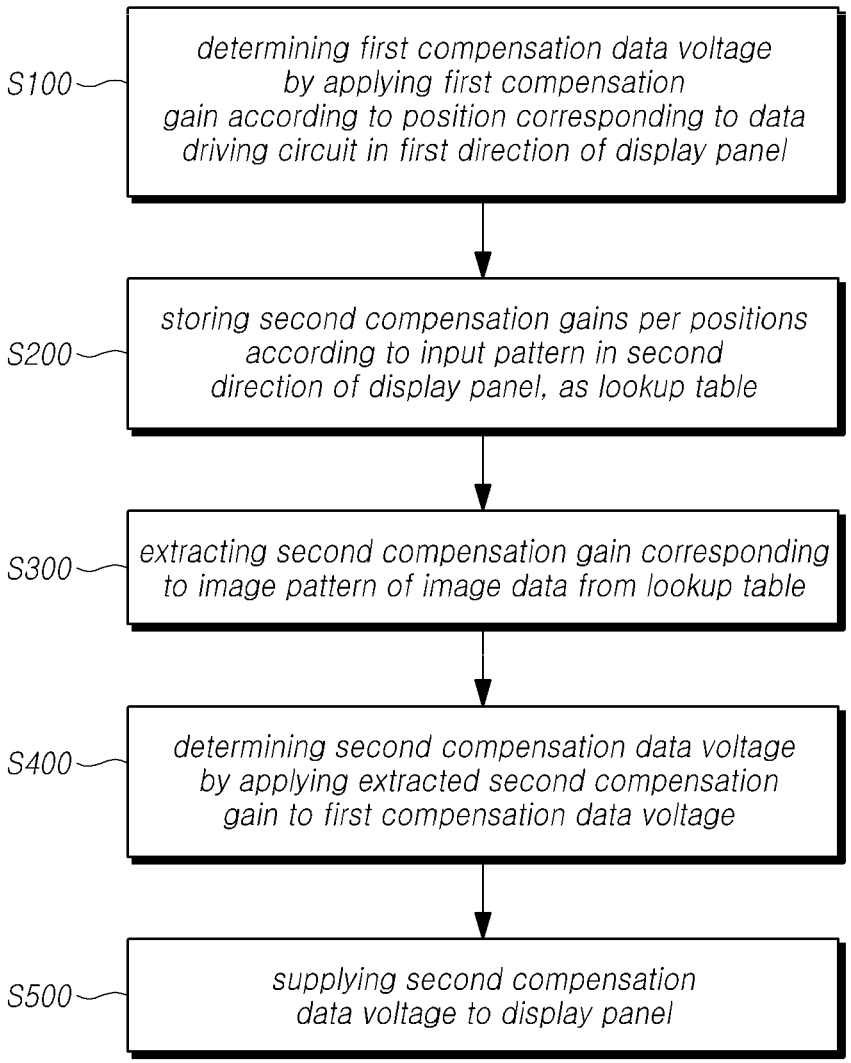
FIG. 13 is a flowchart illustrating a display driving method according to embodiments of the disclosure.

FIG. 13 is a flowchart illustrating a display driving method according to embodiments of the disclosure.

Referring to FIG. 13, a display driving method according to embodiments of the disclosure may include a step S100 of determining a first compensation data voltage by applying a first compensation gain according to a position corresponding to a data driving circuit 130 in a first direction of a display panel 110, a step S200 of storing second compensation gains per positions according to an image pattern, as a lookup table, in a second direction of the display panel 110, a step S300 of extracting a second compensation gain corresponding to the image pattern of image data DATA from the lookup table, a step S400 of determining a second compensation data voltage by applying the extracted second compensation gain to the first compensation data voltage, and a step S500 of supplying the second compensation data voltage to the display panel 110.

The step S100 of determining the first compensation data voltage by applying the first compensation gain according to the position corresponding to the data driving circuit 130 in the first direction of the display panel 110 is a process of dividing an area overlapping the data driving circuit 130 and an area not overlapping the data driving circuit 130 in the first direction in which the data driving circuits 130 are arranged and determining compensated data voltage Vdata_comp considering a voltage drop in driving voltage EVDD depending on the position.

The step S200 of storing the second compensation gains per positions according to the image pattern, as the lookup table, in the second direction of the display panel 110 is a process of storing the second compensation gain of the data voltage Vdata according to the grayscale of an input image in the second direction of the display panel 110, in which the driving voltage line DVL extends, in the form of the lookup table, in a memory. The step S200 may be performed while manufacturing the display device 100 or while driving the display device 100.

The step S300 of extracting the second compensation gain corresponding to the image pattern of the image data DATA from the lookup table is a process of determining the grayscale of the image data DATA input to the display device 100 and extracting, from the lookup table stored in the memory MEM, the per-position second compensation gain for each position of the subpixel SP according to the grayscale of the image data DATA.

The step S400 of determining the second compensation data voltage by applying the extracted first compensation gain to the first compensation data voltage is a process of determining a final compensation data voltage Vdata_comp considering the first compensation data voltage according to the first direction in which the data driving circuits 130 are arranged and the compensation data voltage according to the second direction in which the driving voltage line DVL extends.

The step S500 of supplying the second compensation data voltage to the display panel 110 is a process of supplying the compensated data voltage Vdata_comp determined considering the two-dimensional position of the subpixel SP to the display panel 110.

As such, the display driving method according to embodiments of the disclosure may mitigate luminance non-uniformity depending on the two-dimensional position of the subpixel SP, considering the voltage drop of the driving voltage EVDD varying depending on the position corresponding to the data driving circuit 130 in the first direction of the display panel 110 and the voltage drop of the driving voltage EVDD varying depending on the resistance component of the driving voltage line DVL in the second direction of the display panel 110.

The foregoing embodiments are briefly described below.

According to embodiments of the disclosure, a display device 100 comprises a display panel 110 including a plurality of subpixels SP and a plurality of driving voltage lines DVL supplying a driving voltage to the plurality of subpixels SP, a plurality of data driving circuits 130 configured to supply a data voltage to the display panel 110, a timing controller 140 configured to control the plurality of data driving circuits 130 for supplying a compensated data voltage according to a position of the display panel 110, wherein the compensated data voltage has a first compensation gain for at least some subpixels SP which is varied depending on positions corresponding to the plurality of data driving circuits 130 in a first direction of the display panel, and a second compensation gain for at least some subpixels SP which is varied depending on distances from the plurality of data driving circuits 130 in a second direction of the display panel 110.

The first direction may be a direction in which the plurality of data driving circuits are arranged.

The compensated data voltage may be varied depending on an overlapping area corresponding to the plurality of data driving circuits and a non-overlapping area not corresponding to the plurality of data driving circuits.

The driving voltage lines DVL positioned in the overlapping area Area1 may have a linear structure, and the driving voltage lines DVL positioned in the non-overlapping area Area2 may have a bent structure.

The first compensation gain with low value may be applied to subpixels SP positioned in the overlapping area Area1 among the plurality of subpixels SP, and the first compensation gain with high value may be applied to subpixels SP positioned in the non-overlapping area Area2 among the plurality of subpixels SP.

The second compensation gain may be set to differ depending on positions of subpixels SP with respect to an average grayscale of input image data DATA.

The second compensation gain may be a lookup table stored in a memory MEM.

The compensated data voltage may be determined considering a voltage drop that would be the expected maximum for that data line (e.g., a maximum voltage drop) in a subpixel SP farthest from the plurality of data driving circuits 130 with respect to the average grayscale of the image data DATA.

The compensated data voltage may exhibit a predesignated or selected reference luminance.

The second compensation gain may be applied to subpixels positioned in a non-black grayscale area, among the plurality of subpixels.

A display driving method according to embodiments of the disclosure may include determining a first compensation data voltage by applying a first compensation gain according to a position corresponding to a data driving circuit 130 in a first direction of a display panel 110, storing per-position second compensation gains according to an image pattern, as a lookup table, in a second direction of the display panel 110, extracting a second compensation gain according to the image pattern of input image data DATA from the lookup table, determining a second compensation data voltage by applying the extracted second compensation gain to the first compensation data voltage, and supplying the second compensation data voltage to the display panel 110.

The first direction may be a direction in which the plurality of data driving circuits are arranged.

The second direction may be a direction in which the driving voltage line DVL supplying the driving voltage EVDD to the display panel 110 extends.

The first compensated data voltage may be varied depending on an overlapping area corresponding to the plurality of data driving circuits and a non-overlapping area not corresponding to the plurality of data driving circuits.

The first compensation gain which is low may be applied to subpixels SP positioned in the overlapping area Area1 among the plurality of subpixels SP, and the first compensation gain which is high may be applied to subpixels SP positioned in the non-overlapping area Area2 among the plurality of subpixels SP.

The second compensation gain may be set to differ depending on positions of subpixels SP with respect to an average grayscale of input image data DATA.

The second compensated data voltage may be determined considering a maximum expected voltage drop (e.g., a maximum voltage drop) in a subpixel SP farthest from the plurality of data driving circuits 130 with respect to the average grayscale of the image data DATA.

The second compensated data voltage may exhibit a predesignated or selected reference luminance.

The second compensation gain may be applied to subpixels positioned in a non-black grayscale area, among the plurality of subpixels.

The above description has been presented to enable any person skilled in the art to make and use the technical idea of the present disclosure, and has been provided in the context of a particular application and its benefits. Various modifications, additions and substitutions to the described embodiments will be readily apparent to those skilled in the art, and the general principles described herein may be applied to other embodiments and applications without departing from the spirit and scope of the present disclosure. The above description and the accompanying drawings provide an example of the technical idea of the present disclosure for illustrative purposes only. That is, the disclosed embodiments are intended to illustrate the scope of the technical idea of the present disclosure. Thus, the scope of the present disclosure is not limited to the embodiments shown, but is to be accorded the widest scope consistent with the claims. The scope of protection of the present invention should be construed based on the following claims, and all technical ideas within the scope of equivalents thereof should be construed as being included within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a display panel including a plurality of subpixels and a plurality of driving voltage lines supplying a driving voltage to the plurality of subpixels;

a plurality of data driving circuits configured to supply a data voltage to the display panel; and a timing controller configured to control the plurality of data driving circuits for supplying a compensated data voltage according to a position in the display panel, wherein the compensated data voltage has:

a first compensation gain for a set of first subpixels, the first compensation gain being varied based on positions corresponding to the plurality of data driving circuits in a first direction of the display panel; and a second compensation gain for a set of second subpixels, the second compensation gain being varied based on distance from the plurality of data driving circuits in a second direction of the display panel, wherein the first direction is a direction in which the plurality of data driving circuits are arranged, and the second direction is perpendicular to the first direction, wherein the first compensation gain is varied based on a first area that overlaps the plurality of data driving circuits and a second area that is not overlapping the plurality of data driving circuits.

2. The display device of claim 1, wherein the driving voltage lines positioned in the first area have a linear structure from the plurality of data driving circuits, and the driving voltage lines positioned in the second area have a bent structure from the plurality of data driving circuits.

3. The display device of claim 1, wherein the first compensation gain is applied using a first value to subpixels positioned in the first area, and the first compensation gain is applied using a second value to subpixels positioned in the second area, the second value being greater than the first value.

4. The display device of claim 1, wherein the second compensation gain is set to differ based on positions of the at least some second subpixels and based on an average grayscale of input image data.

5. The display device of claim 4, wherein the second compensation gain is stored in a lookup table stored in a memory.

6. The display device of claim 4, wherein the compensated data voltage is determined based on voltage drop associated with a subpixel farthest from the plurality of data driving circuits and based on the average grayscale of the image data.

7. The display device of claim 1, wherein the compensated data voltage is associated with a selected reference luminance.

8. The display device of claim 1, wherein the second compensation gain is applied to subpixels positioned in a non-black grayscale area.

9. A display device comprising:

a data driving circuit; and a display panel including:

a first subpixel coupled to a data line of the data driving circuit;

a second subpixel coupled to the data line, the first subpixel being between the data driving circuit and the second subpixel;

a third subpixel coupled to a second data line adjacent the data line, and coupled to a second driving voltage line adjacent the driving voltage line;

a driving voltage line coupled to the first subpixel and the second subpixel;

wherein, in an image frame, the data line, in operation:

applies a first compensated data voltage to the first subpixel, the first compensated data voltage being generated based on a first value of a second compensation gain; and applies a second compensated data voltage to the second subpixel, the second compensated data voltage being generated based on a second value of the second compensation gain, the second value being greater than the first value, wherein the first and second subpixels are in the first area that overlaps the data driving circuit, and the third subpixel is in the second area that is not overlapping the data driving circuit and a second data driving circuit adjacent to the data driving circuit wherein the data line, in operation:

supplies the third compensated data voltage to the third subpixel, the third compensated data voltage being generated based on a first compensation gain, the first compensation gain being higher in the second area than in the first area.

10. The display device of claim 9, further including:

a memory storing the first value and the second value;

a compensation circuit that, in operation, generates compensated image data associated with the image frame based on the first value and the second value, and outputs the compensated image data to the data driving circuit; and a digital-to-analog converter that, in operation, generates the first compensated data voltage and the second compensated data voltage based on the compensated image data.

11. The display device of claim 10, wherein the display device, in operation, determines the second compensation gain based on a voltage drop of a driving voltage supplied by the driving voltage line, the voltage drop being determined according to a position along a second direction in which the driving voltage line extends.

12. The display device of claim 11, wherein the compensation circuit, in operation, compensates for a deviation in the driving voltage associated with the position, the compensating being according to a value of the second compensation gain stored in the memory.

13. The display device of claim 9, wherein the first value and the second value are generated as a fraction of a grayscale associated with the color white.

14. The display device of claim 13, wherein the fraction decreases with increased proximity to the data driving circuit.

15. A method comprising:

generating a third compensated data voltage based on a value of a first compensation gain, applying a first compensated data voltage to a first subpixel, the first compensated data voltage being generated based on a first value of a second compensation gain and the third compensated data voltage and being applied via a first data line, the first value being associated with a first distance from the data driving circuit, the first subpixel being in an image frame; and applying a second compensated data voltage to a second subpixel in the same image frame, the second compensated data voltage being generated based on a second value of the second compensation gain and the third compensated data voltage and being applied via the first data line, the second value being associated with a second distance from the data driving circuit, the second distance being greater than the first distance, the second value being greater than the first value;

wherein the value of the first compensation gain is higher in a second area than in a first area, wherein the first area overlaps the data driving circuit, and the second area is not overlapping the data driving circuit.

16. The method of claim 15, further comprising:

generating compensated image data associated with the image frame based on the first value and the second value;

outputting the compensated image data to the data driving circuit; and generating the first compensated data voltage and the second compensated data voltage based on the compensated image data.

17. The method of claim 15, further comprising:

applying in the image frame, by a second data line adjacent to the first data line, the third compensated data voltage to a third subpixel, the third compensated data voltage being generated based on a value of a first compensation gain, the value being associated with the second area in which the third subpixel is positioned, the second area being between the data driving circuit and a second data driving circuit adjacent the data driving circuit, the first subpixel being in a-the first area overlapping the data driving circuit, the value being greater than another value associated with the first area.

* * * * *